United States Patent [19]

Mallardi et al.

[11] Patent Number: 4,735,041

[45] Date of Patent: Apr. 5, 1988

[54] DEVICE FOR CONTINUOUS SPINNER

[76] Inventors: Ugo Mallardi, Via delle Campora 80, Firenze; Ugo R. Menicacci, Via Carlesi, 9, Prato (Firenze), both of Italy

[21] Appl. No.: 35,650

[22] Filed: Apr. 7, 1987

[30] Foreign Application Priority Data

Apr. 8, 1986 [IT] Italy ..... 9635 A/86
Mar. 12, 1987 [IT] Italy ..... 9344 A/87

[51] Int. Cl.[4] ..... D01H 5/28; D01H 15/00

[52] U.S. Cl. ..... 57/280; 57/279; 57/329; 57/330

[58] Field of Search ..... 57/280, 279, 329–331, 57/315

[56] References Cited

U.S. PATENT DOCUMENTS

| | | | |
|---|---|---|---|
| 617,682 | 1/1899 | Emery | 57/330 X |
| 1,435,912 | 11/1922 | Binns | 57/279 |
| 1,474,131 | 11/1923 | Zachariadis | 57/330 |
| 1,922,949 | 8/1933 | Harris | 57/330 |
| 1,962,265 | 6/1934 | Wenzel | 57/280 |
| 2,427,955 | 9/1947 | Furness | 57/330 X |
| 2,688,837 | 9/1954 | Hadwich | 57/330 |
| 2,796,725 | 6/1957 | Urrutia | 57/330 |
| 3,114,231 | 12/1963 | Selling et al. | 57/331 |
| 3,217,483 | 11/1965 | Kato et al. | 57/279 X |

*Primary Examiner*—John Petrakes
*Attorney, Agent, or Firm*—McGlew and Tuttle

[57] ABSTRACT

Device for continuous spinner with draft and simultaneous actual pre-twist wherein the draft motion is derived via a gear train from the pre-twist motion so as to utilize only one motion drive and wherein the thread being formed is controlled by an air stream operating around and in the feeding direction thereof; the thread moves through the apparatus advancing inside a revolving sleeve located either up-stream or down-stream of the draft unit and rotating therewith and concordantly with the thread that is being formed.

22 Claims, 9 Drawing Sheets

DEVICE FOR CONTINUOUS SPINNER

BACKGROUND OF THE INVENTION

The present invention refers to a device for a continuous spinner.

In the past, spinning of fibers, in particular short fibers, was performed using a continuous spinner. In performing such operation, it has been necessary to give the rove either a false or an actual pre-twist. Presently, continuous spinning machines are predominantly of the false pre-twist type. This type is selected as they are more practical and reliable than machines performing the actual pre-twist.

The known pre-twist devices require two independent motion drives, one for the twist and the other for the draft. This involves the use of additional mechanical means and a waste of motive power. Additionally, this brings about mechanical problems such as excessive overall dimensions, high noise, lubrication difficulties and also irregularities in the draft and number of twists per meter even in the case of small changes of relative velocity between the primary twist-motion members and those causing the draft. Further, this type of arrangement does not allow the automatic introduction of the rove through the draft unit when the spinner is at a standstill or when it is in motion and, finally, in case of rupture of the thread downstream of the draft unit, the same thread winds up on the cylinders of said draft unit thus forcing the user to stop all the spindles in order to recover it.

SUMMARY AND OBJECT OF THE INVENTION

It is an object of the invention to overcome the drawbacks related to the previous devices and to provide the draft with actual pre-twist in a continuous spinning machine thereby improving its output.

According to the invention, the draft motion is derived, via a train of gears, from the pre-twist motion so as to utilize a single motion drive and to control the thread that is being formed. The thread is formed by means of an air stream operating around and in the advancement direction of same thread, inside a sleeve located either up-stream or down-stream of the draft unit and rotating along with the latter and concordantly with the thread that is being formed.

The advantages of the invention are essentially due to the fact that the means for obtaining the draft and the simultaneous pre-twist are ridigly connected to each other and there is only one motion drive provided. The twists are uniformly distributed over the whole thread length between the feeding unit and the draft unit and between this and the thread-collecting spindle. The rove end, which comes out from the feeding unit, is automatically introduced into the draft unit while the spinner is in operation. The thread, in the process of formation, is prevented from entering in contact with the fixed part of the spinner. In case of a breaking of the thread, the thread is prevented from winding up on the cylinders of the draft unit and is pushed downwards vertically, thus avoiding the centrifugal and aerodynamic effects of the rotating part of the mechanism. An air stream allows an automatic and continuous cleaning of the draft unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
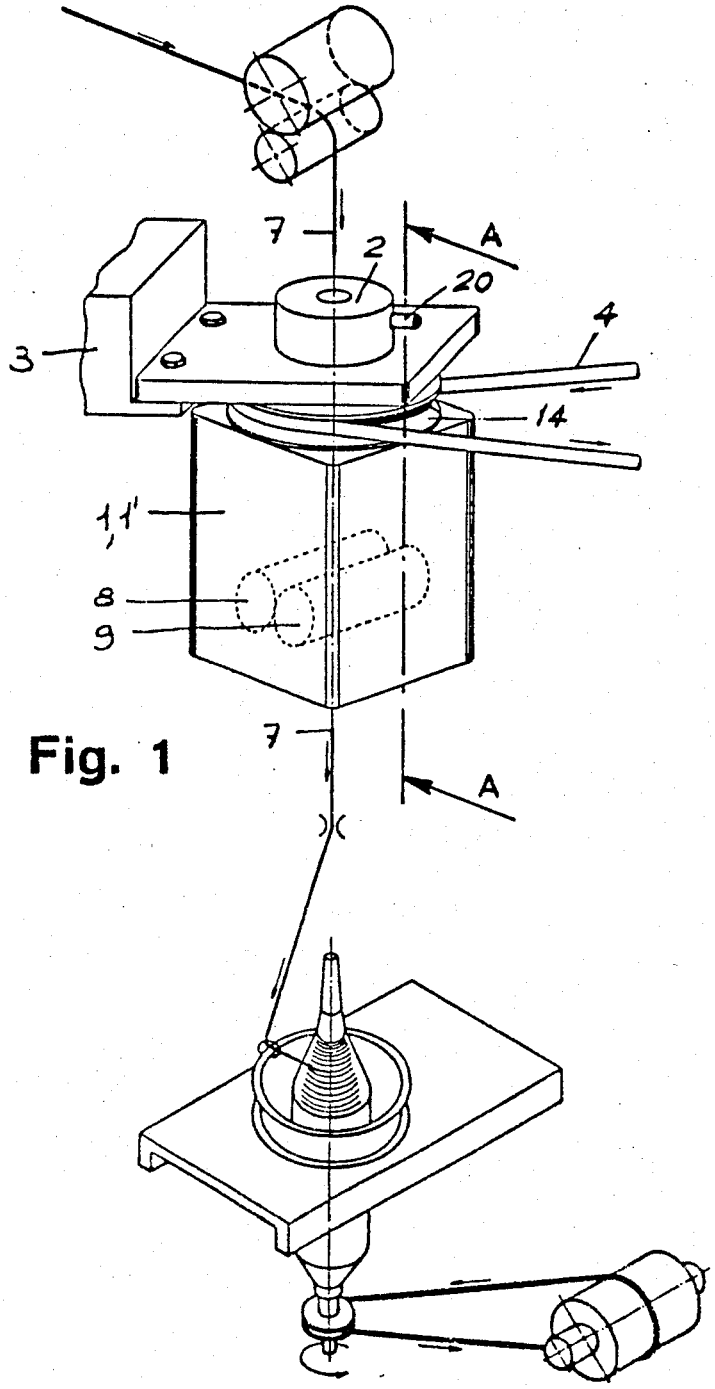
FIG. 1, shows a schematic view of a device for continuous spinning according to the invention, in operative condition.

Referring to the drawings in particular, the invention embodied therein comprises a continuous spinning machine including a body formed of two pieces 1, 1', the two pieces have a first cavity 10 opening on the top and communicating with an underlying second cavity 12. The second cavity 12 is provided at its bottom with a hole 15 defining an output of the thread 7 as it is formed. The body 1, 1' is mounted, by means of a ball bearing arrangement 16, on a hollow pivot 2 which is, in turn vertically secured to a fixed part 3 of the spinner. The hollow pivot 2 includes a mouth 13 which is advantageously counter sunk to ease the introduction of the thread 7, which is to be formed. The motion of rotation of the body 1, 1' is imparted by a drive (not shown) through a belt 4 and a pulley 14. Pivot 2 is formed integrally with a worm screw 21, and defines an inside coaxially sleeve 5, which is fixed, by its lower end, at body 1. Adjacent the hole 13, the pivot 2 is provided with a nozzle 20 which is downwardly inclined. The nozzle 20 is provided for the inlet of compressed air intended to generate a stream inside the sleeve 5 for the control of the thread 7 as it passes through the sleeve 5 during the pretwist and draft phase.

Within the cavity of the body or housing 1, a shaft 6 is seated with a helical gear 60 in meshing engagement with said worm 21.

Within the cavity 12 of the body or housing 1, 1', two cylinders 8, 9 of the draft unit are housed. Cylinder 8 is a motive cylinder and the cylinder 9 is a presser cylinder, whose horizontal axes lie on the same horizontal plane symmetrically positioned with respect to the axis of the sleeve 5. The motion of rotation of the motive cylinder 8 is derived from the shaft 6 through a train of gears 81, 82, 83, 84, 85 whose gear 83 is advantageously shiftable so as to disengage the idle gear 84 and, respectively, engage the gear 85 thereby reversing the direction of rotation of the body 1, 1' while leaving the direction of rotation of the draft unit cylinders about their own axes unchanged. This arrangement allows the imparting of twists Z and S, respectively, to the thread 7; the shifting of gear 83 being automatically caused by the reversal of rotation of the body 1, 1'.

Figure 7C:
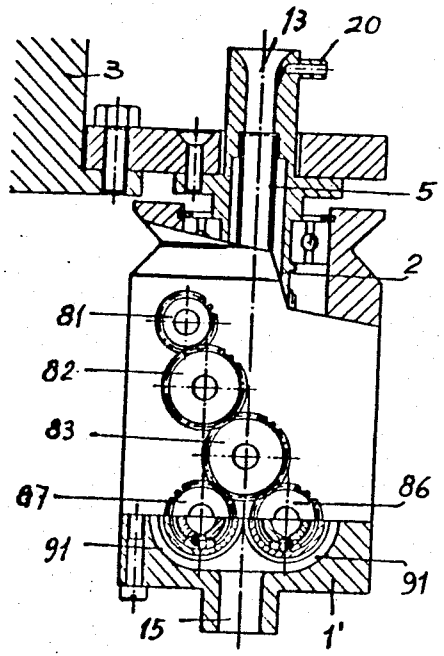
FIG. 7C, shows the detail, partly sectioned, of a free wheels-reverser for the device of FIG. 2.
Figure 7B:
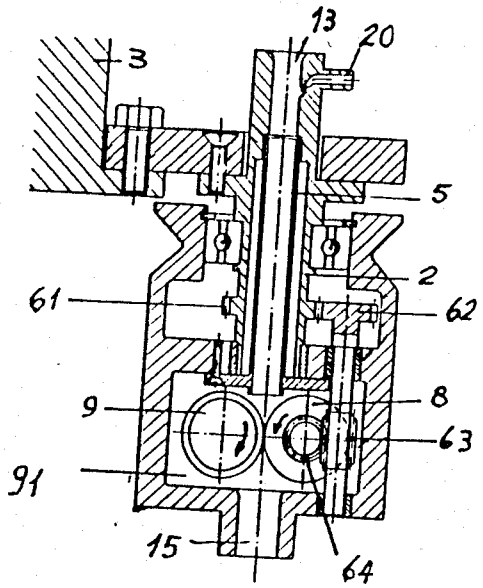
FIG. 7B, shows the detail, in vertical section, of a further modified embodiment of the inner gear train of the device of FIG. 2.
Figure 7A:
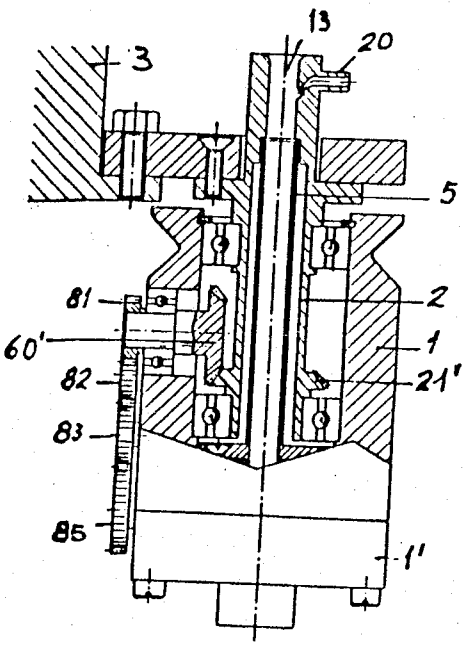
FIG. 7A, shows a detail, in vertical section, of a modified embodiment of the inner gear train of the device of FIG. 2.

It will be appreciated that in place of the assembly of worm 21 and helical gear 60, a group of bevel gears 21', 60' of the type illustrated in FIG. 7A of the attached drawings may also be provided. Further, in place of the train of gears 21, 60, 81, 85, a train of gears 61, 62, 63, 64 of the type illustrated in FIG. 7B of the attached drawings may be provided as well. Similarly, in place of a reversing idle gear 84, a reverser having free-gears 86, 87 illustrated in FIG. 7C of the attached drawings, may be provided.

The air stream coming out from the sleeve 5 heads towards the outlet 15, goes through the space 91 (see FIG. 2) that surrounds the cylinder 8, 9 of the draft unit, and sweeps their surface as they move opposite to the direction of advancement of same air stream.

The drive between the screw 21 and the cylinder 8 of the draft unit allows the draft and pre-twist of the thread 7 that is being formed to be achieved through the rotation of body 1, 1' only, which rotation may occur at high speed and low torque.

Further, the resulting thread is regularly formed due to the fact that the draft unit 8, 9 and the rotating body 1, 1' are rigidly connected thereby preventing a lack of regularity in the thread due to small changes in the speed of the two rotating members.

It will be appreciated that the number of revolutions per minute of the body 1, 1', the velocity (transmission) ratio of the inner gear train 21–85 and the diameter of the cylinders of the draft unit 8, 9 may vary in order to obtain a number of twists in the thread ranging between 10 and 400.

Figure 6:
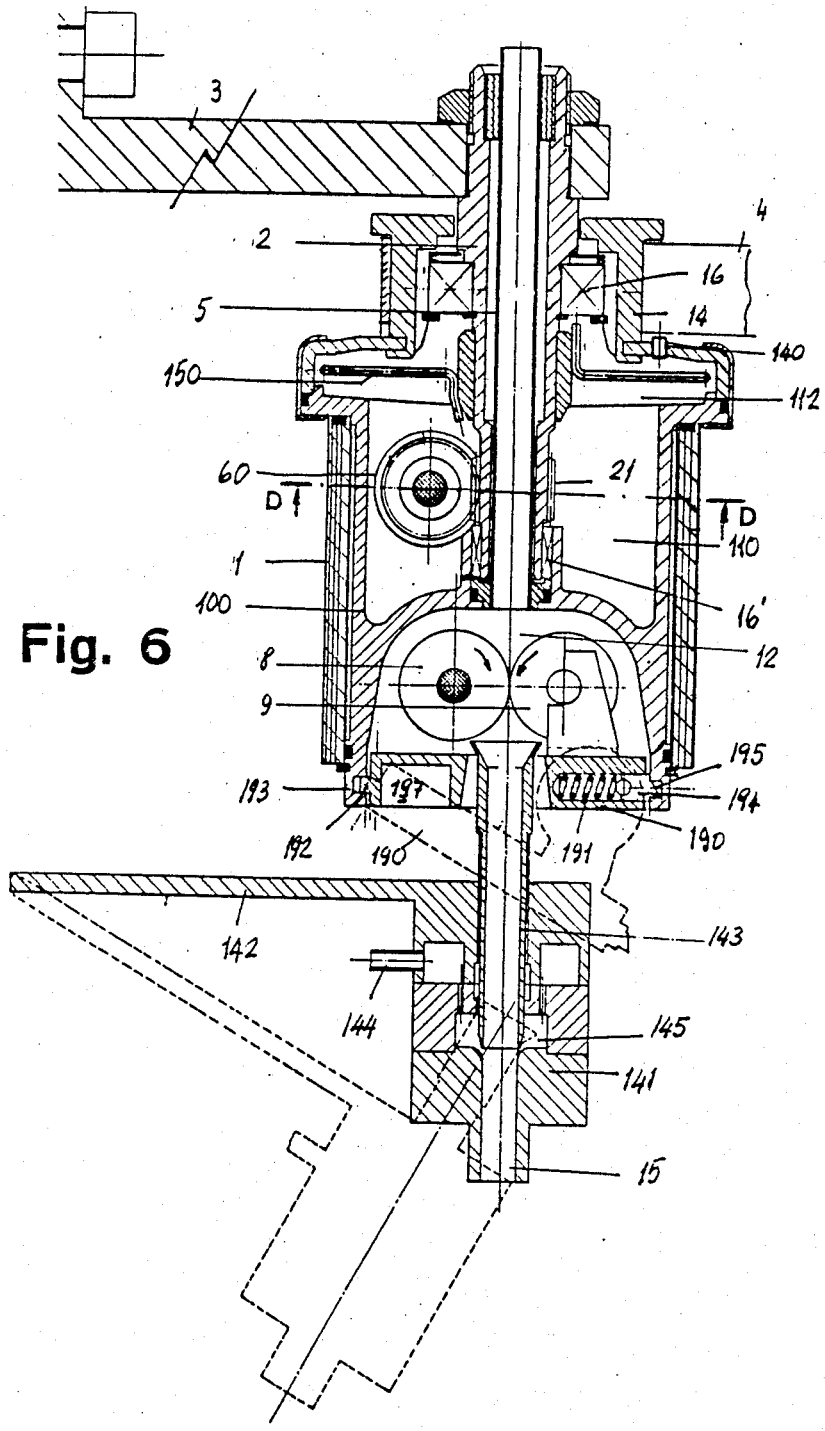
FIG. 6, shows a vertical axial section of a device improved embodiment of FIG. 2.
Figure 6A:
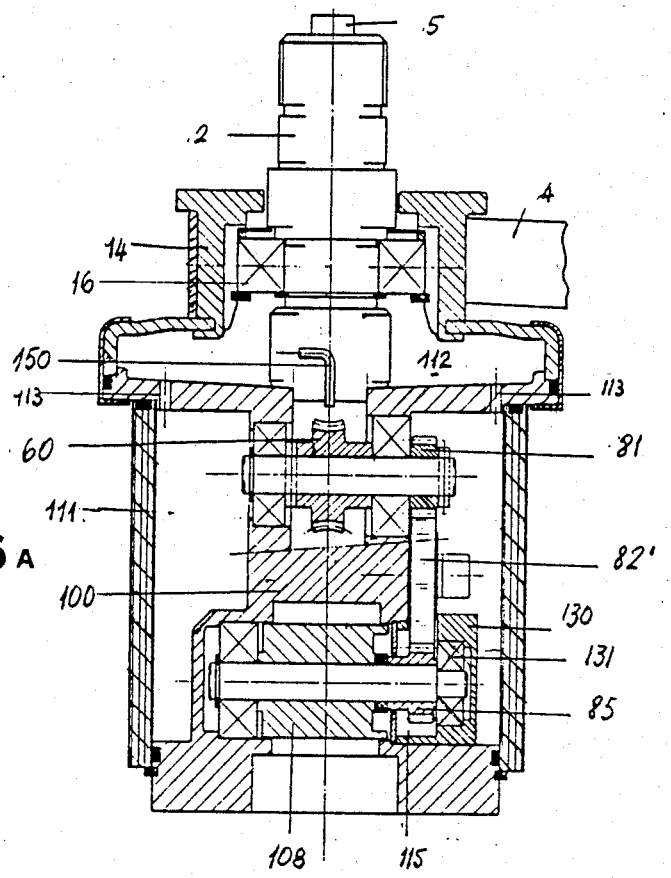
FIG. 6A, shows a vertical section on a plane orthogonal to that of FIG. 6.
Figure 6B:
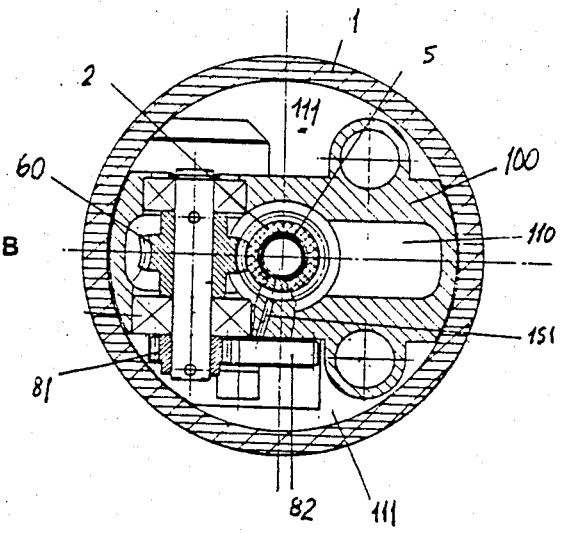
FIG. 6B, shows a section on line D—D of FIG. 6.

Referring to the embodiment shown in FIGS. 6–6B, the invention shown in these figures includes a hollow body 1 housing a structure 100 which is mounted, through bearing 16, 16', on a hollow pin 2. Hollow pin 2 is formed integral with the fixed part 3 of the spinner and supports the drive cylinder 8 of the draft group and also supports the gear train 60, 81–82', 85. The gear train transmits the rotational motion of the body 1, which is imparted by a belt 4 and a pulley 14, to a drive cylinder 8, in cooperation with the worm screw 21 secured on the fixed pin 2. The walls of the structure 100 delimit, in conjunction with the walls of body 101, three communicating chambers 110–112. Chamber 110 is internal to the structure 100. Chamber 111 is external to the structure 100 and chamber 112 is overhead or above the structure 100 and has a diameter larger than the diameter of chamber 111. The chambers 110–112 are provided for holding a suitable amount of lubricating oil which is introduced into these through an inlet 140 connecting to the upper chamber 112. By means of these chamber, lubricating oil is delivered to the gear train and to the bearings of the various shafts through a centrifugal effect caused by the rotation of the body 1.

In the upper chamber 112, an oiler is fixed on the pin 2. The oiler includes bent arms which advantageously provide for collecting the lubricant which, during the rotation of the body 1, is present on the wall of said changer 112 and for distributing it, respectively, to the upper bearing 16 and to the worm-helical gear group 21. 60 from which it drops onto the lower bearing 16. A tube 151 is provided in the structure 100 for the intake and the possible drainage of the lubricant to and from the shaft bearing of gear 82'.

During the rotation of the body 1, the thread under formation which passes inside the sleeve 5 is never reached by the lubricating oil present in the chamber 110 since the base of the sleeve 5 is tightly fixed on the structure 100 to provide a seal.

During the static phase (that is when the spinner is at rest), the lubricating oil present in the upper chamber 112 goes down through the holes 113 into the external chamber 111 and the oil finds its way to the bottom. The oil amount is such that its level does not exceed that lid 130 for the protection of the bearing 131 of the drive cylinder 8 of the draft group, thereby the cylinder 8 cannot be reached by the lubricating oil, due to the cooperation of a labyrinth path 115 located downstream of the lid 130. The lid 130 allows only for the passage, upon the dynamic phase (that is when the spinner is in operation), of a small amount of oil sufficient for the lubrication of the bearing 131. Should the lubricant reach the bearing in an excessive amount, this surplus amount of oil would be automatically discharged into the chamber 111 through the opening delimited by the sides of the lid 130 and by the gear 82'.

A slide 190 carries the pressure cylinder 9 of the draft group and at least a spring 191, for adjusting the pressure on the drive cylinder 8. The slide is removably mounted on the base of structure 100 by means of a tooth 192 located in correspondence of one end of the slide and able to be received in a corresponding cavity 193 of the structure 100 by means of a peg 194 slidably housed in the other end of the slide and lined up with the spring 191 whose head 195 is able to engage a corresponding through hole of the structure 100.

By this construction, the slide may be removed to inspect the two cylinders 8, 9 of the draft group and possible even replace the pressure cylinder 9. The slide 190 is also provided with a counterweight located in a corresponding opening 197 at a position diametrically opposite in respect to the spring 191 so as to statically balance the slide.

A compressed air ejector 141 is mounted on an arm 142 and supported by the fixed part of the spinner independent of the body 1'. The ejector 141 includes intake tube 143 located downstream of the draft group-8, -9 so as to be able to collect the forming thread going out therefrom and to guide it as far as the exit 15 of the device. The intake compressed air going through the duct 144 arrives at an annular chamber 145 which is concentric to said pipe 143 so as to lap the mouth thereof with an inclination of about 45° or less. The end of tube 143 and of the facing ejector have beveled edges. The arm 142 is advantageously articulated to the spinner allow, by a vertical rotative movement, the intake tube 143 to be moved away from and, respectively, close to the draft group; 8, 9. This allows the removal of the slide 190 by means of the pressure cylinder 9 of the draft group.

Figure 2:
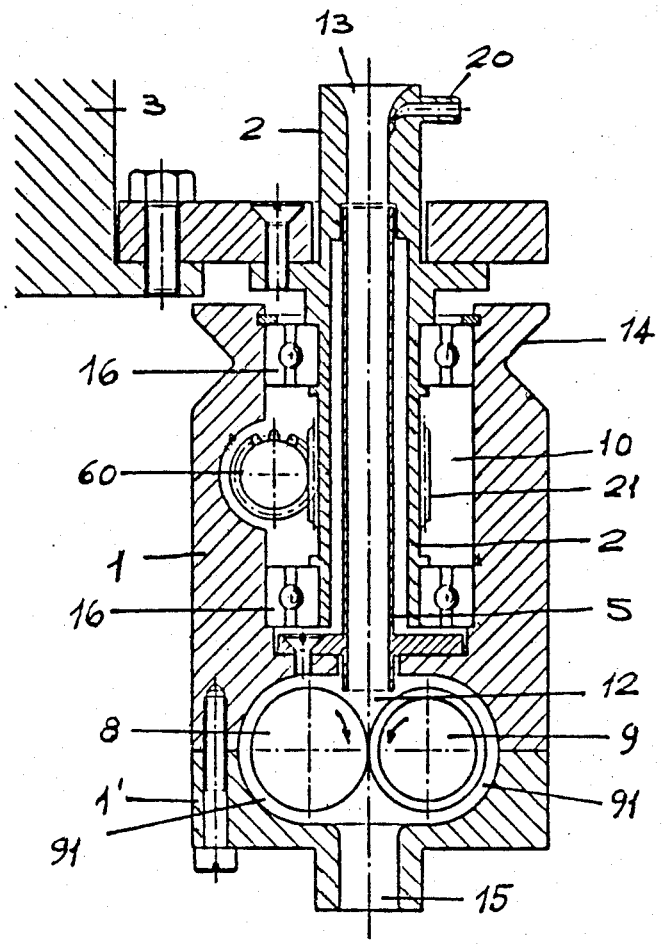
FIG. 2, shows a section view on line A—A of FIG. 1.
Figure 3:
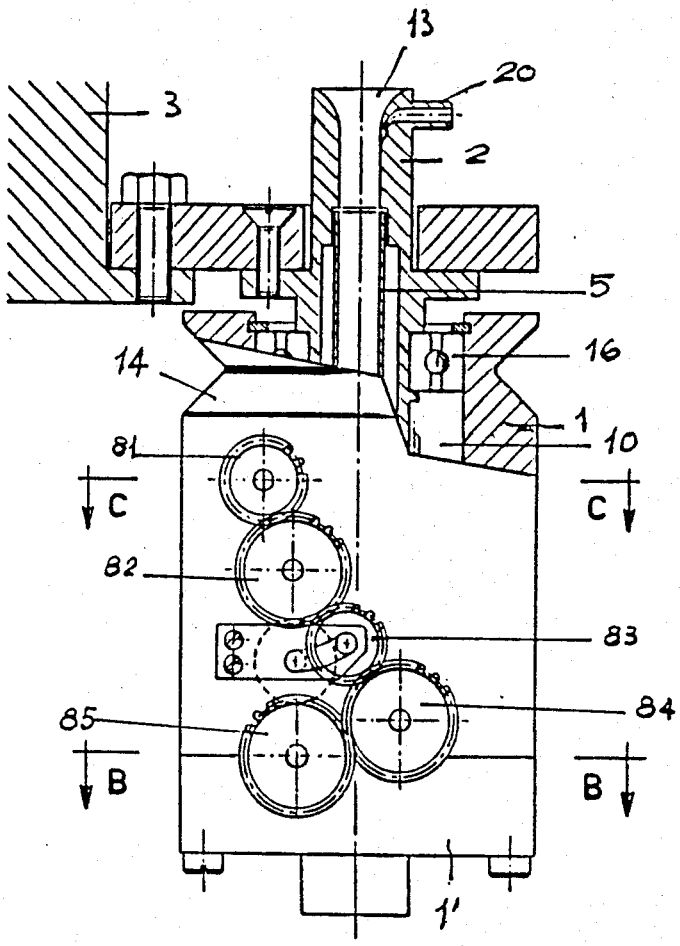
FIG. 3, shows the front view, partly sectioned, of the device of FIG. 2.
Figure 4:
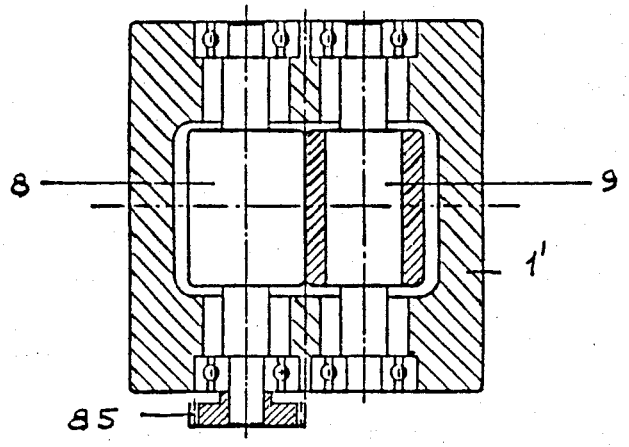
FIG. 4, shows a section on line B—B of FIG. 3.
Figure 5:
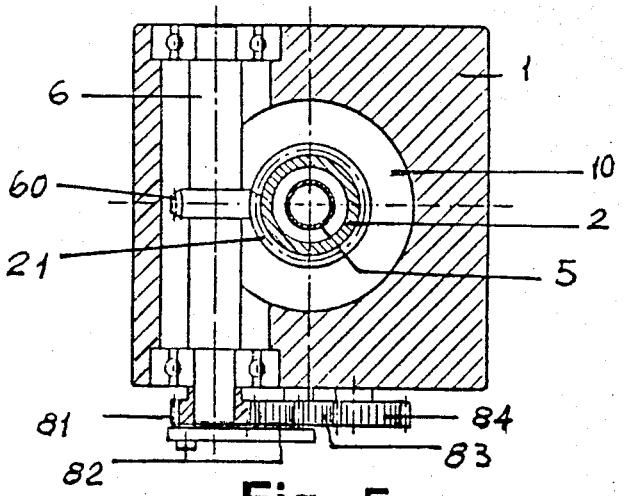
FIG. 5, shows the section view on line C—C of FIG. 3.
Figure 8:
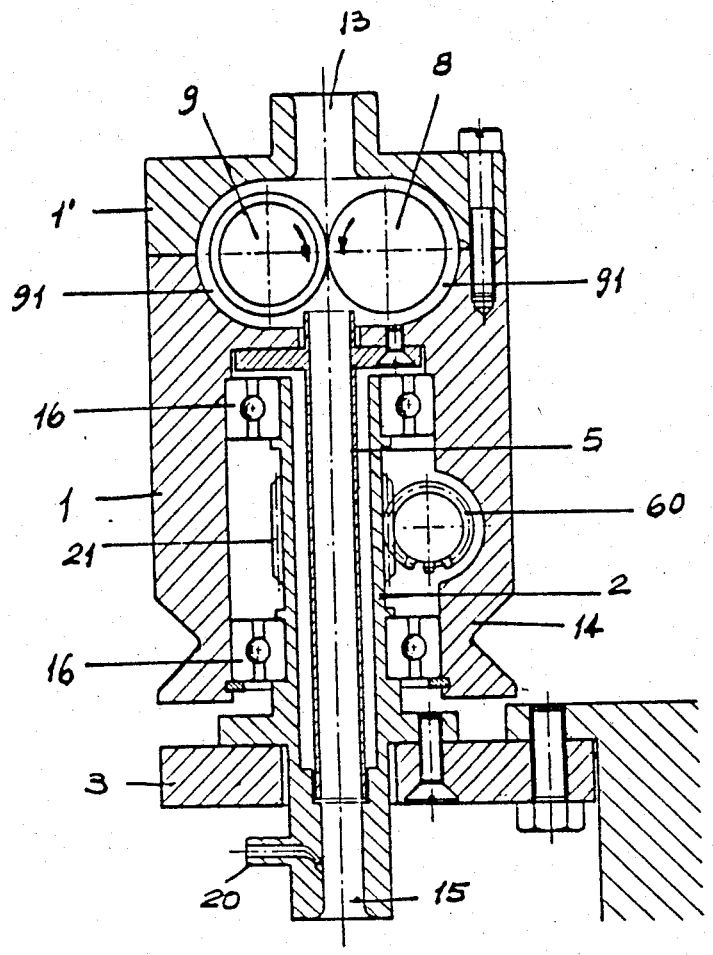
FIG. 8, shows the axial vertical section of a modified embodiment of the device of FIG. 2; and, FIG. 9, shows the axial vertical section of a modified embodiment of the device of FIG. 2.

According to another embodiment of the invention shown in FIG. 8 of the attached drawings, the body 1, 1' with the pivot 2 and draft unit 8, 9, is provided in overturned arrangement in respect to the position of the mechanism of FIG. 2, and the nozzle 20, for the admission of compressed air intended to generate the air stream inside the sleeve 5 and around the cylinders 8, 9 of the draft unit, is provided close to the hole 15 for the exist of the thread 7 that is being formed.

Figure 9:
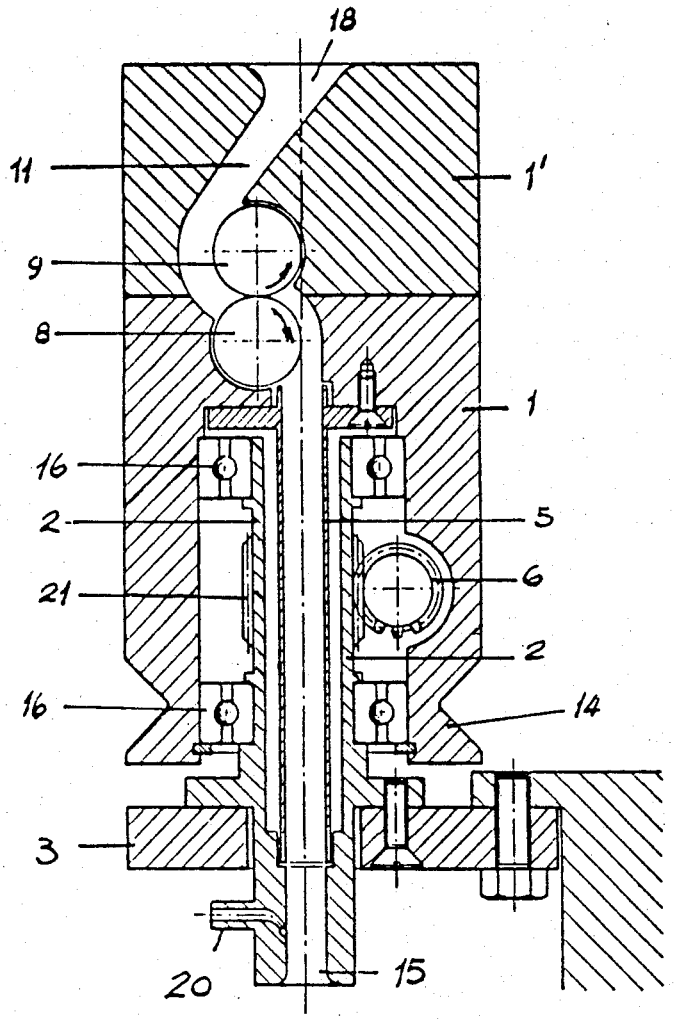

According to another embodiment of the invention shown in FIG. 9 of the attached drawings, a draft unit is placed with the axes of cylinders 8, 9 on a same vertical plane and laterally of the axis of sleeve 5, and the cavity 12 of body 1, 1' is provided with a joining duct 11 having a hole 18 for the introduction of the thread 7 that is being formed.

While a specific embodiment of the invention has been shown and described in detail to illustrate the application of the principles of the invention, it will be understood that the invention may be embodied otherwise without departing from such principals.

We claim:

1. A continuous spinner comprising: a tubular pivot having a central axis; a support, connected to said tubular spinner, supporting said tubular spinner; a housing mounted for rotation about the central axis of said tubular pivot; a draft unit mounted within said housing for rotation therewith, the draft unit including a motive cylinder and a presser cylinder, each having an axis of rotation with respect to said housing; a gear train mounted on said housing and driven as said housing rotates relative to said tubular pivot and connected to said draft unit for driving said cylinders; a sleeve positioned in the tubular pivot for transmitting thread to be formed, the said sleeve being fixed to the body for rotation therewith; and, means for generating an air stream inside said sleeve, the air stream moving about and along thread as the thread is transmitted through the sleeve, the air stream moving about said cylinders and exiting through a hole formed in said housing.

2. A continuous spinner according to claim 1, wherein: said tubular support includes a gear element engaging said gear train so as to drive said gear train as said housing rotates about the central axis of said tubular pivot.

3. A continuous spinner according to claim 1, wherein: said housing includes an inner structure carrying the motive cylinder of the draft unit and the gear train, the inner structure with the housing defining three communicating chambers for holding lubrication oil, the oil being distributed for lubrication of the gear train and bearings of the gear train through said centrifugal force generated upon the rotation of the housing.

4. A continuous spinner according to claim 3, wherein: the communicating chambers include an upper chamber and two lower chambers, one lower chamber being open and communicating with the upper chamber, the other lower chamber being connected with the upper chamber through a plurality of lubrication oil passages.

5. A continuous spinner according to claim 4, wherein: the upper chamber has a diameter which is larger than the diameter of the lower chambers.

6. A continuous spinner according to claim 4, further comprising: an oiler fixed to said tubular pivot, the oiler being formed of a plurality of arms which are alternatively oriented upwards and downwards for distribution of oil.

7. A continuous spinner according to claim 3, further comprising: a lid and a labyrinth oil path which prevents lubricating oil in said housing from reaching the drive cylinder of the draft unit.

8. A continuous spinner according to claim 3, wherein: said inner structure has a lower base having a removable slide, said removable slide supporting said pressure cylinder of said draft unit and being interlocked with said housing by means of an adjusting spring.

9. A continuous spinner according to claim 8, wherein: said slide includes a peg positioned within said slide and engaging said spring, said peg having a head which is adapted to engage a corresponding through hole provided in said inner structure.

10. A continuous spinner according to claim 8, wherein: said slide is provided with a counter weight, disposed diametrically opposite to said spring so as to balance said slide.

11. A continuous spinner according to claim 1, wherein: the thread to be formed is fed through said draft unit and said tubular pivot and said sleeve are positioned upstream of said draft unit.

12. A continuous spinner according to claim 1, wherein: the thread to be formed is fed through said draft unit and said pivot and said sleeve are provided downstream of said draft unit.

13. A continuous spinner according to claim 1, wherein: said gear train provides a transmission ratio between the speed of rotation of said housing and the speed of rotation of said cylinders associated with said draft unit, the transmission ratio being adjustable so as to obtain 10–400 twists per meter of thread being formed.

14. A continuous spinner according to claim 1, wherein: said means for generating an air stream includes a nozzle injecting compressed air, the nozzle being positioned close to an upper end of the tubular pivot, up-stream of said cylinders of said draft unit, said nozzle being directed in the feeding direction of thread that is being formed.

15. A continuous spinner according to claim 1, wherein: said means for generating an air stream includes a nozzle for injection of compressed air, the nozzle being positioned on a lower end of said tubular pivot, down-stream of said draft unit, said nozzle being directed in a feeding direction of thread that is to be formed.

16. A continuous spinner according to claim 1, wherein: said means for generating an air stream includes an arm fixed to a support which is stationary relative to the rotating housing, the arm being articulated relative to the support, a compressed air ejector mounted on the arm, the compressed air ejector having an intake tube located downstream of the draft unit in relation to the direction of transmitted thread which is to be formed, so as to collect the forming thread coming out of said draft group and to guide the thread to an exit.

17. A continuous spinner according to claim 16, wherein: said ejector includes an annular chamber positioned concentric with said intake tube so that the compressed air introduced into said annular chamber will lap the mouth of said annular chamber with an inclination less than or equal to 45°.

18. A continuous spinner according to claim 1, wherein: said gear train includes a reverser having cylindrical gears with at least an idler gear, the idler gear being engageable and disengageable with the gear train so as to reverse the rotation of said housing and simultaneously maintain the direction of rotation of said cylinder associated with said draft unit so thread being formed obtains a Z twist or a S twist.

19. A continuous spinner according to claim 1, wherein: said gear train includes a reverser.

20. A continuous spinner according to claim 1, wherein: said cylinders, associated with said draft unit each include a central axis lying in a horizontal plane, the cylinders being disposed symmetrically with respect to an axis of said sleeve.

21. A continuous spinner according to claim 1, wherein: said cylinders, of said draft unit are disposed laterally of a central axis of said sleeve.

22. A continuous spinner according to claim 1, wherein: said housing includes a cavity for retaining said cylinders associated with said draft unit, said cavity including a hole and a duct for admission of thread.

* * * * *